United States Patent [19]

Aust

[11] 4,126,222

[45] Nov. 21, 1978

[54] REINFORCED FORM-FITTING SHIPPING CONTAINER

[75] Inventor: John J. Aust, Toledo, Ohio

[73] Assignee: Owens-Illinois, Inc., Toledo, Ohio

[21] Appl. No.: 867,401

[22] Filed: Jan. 6, 1978

[51] Int. Cl.[2] ..... B65D 85/54

[52] U.S. Cl. ..... 206/326; 229/23 R; 206/314

[58] Field of Search ..... 229/23 R, 16 R, 8; 206/314, 326

[56] References Cited

U.S. PATENT DOCUMENTS

| | | | |
|---|---|---|---|
| 471,043 | 3/1892 | Webb | 206/314 |
| 1,188,825 | 6/1916 | Potter | 206/326 |
| 1,686,834 | 10/1928 | Nickerson | 206/326 |
| 2,313,362 | 3/1943 | Rous | 206/326 |
| 2,346,003 | 4/1944 | Bishop | 206/326 |
| 2,675,955 | 4/1954 | Gibbons | 206/326 X |
| 2,832,525 | 4/1958 | Cavin | 229/23 R |
| 3,181,768 | 5/1965 | Flynn et al. | 206/326 X |
| 3,978,982 | 9/1976 | Duncan | 206/326 |

*Primary Examiner*—Davis T. Moorhead

*Attorney, Agent, or Firm*—John R. Nelson; Myron E. Click; David H. Wilson

[57] ABSTRACT

A reinforced form-fitting shipping container from a single blank of generally rectangular outline and particularly suited for the shipping and storing of upholstered furniture. As used for upholstered chairs of the type having a relatively low seat and a backrest, the container comprises an intermediate horizontal wall overlying a front portion of the chair, a horizontal top wall extending over the top of the backrest, and an inclined upper front wall extending between the intermediate horizontal wall and top wall. The container is reinforced at areas of increased stress by integral reinforcing elements providing a multi-ply construction of the inclined upper front wall and preferably also of the intermediate horizontal wall and top wall. In the preferred embodiments, the inclined upper front wall is reinforced and stabilized by overlapping scored and folded portions formed thereunder and extending from a pair of sidewalls.

5 Claims, 5 Drawing Figures

FIG. 2
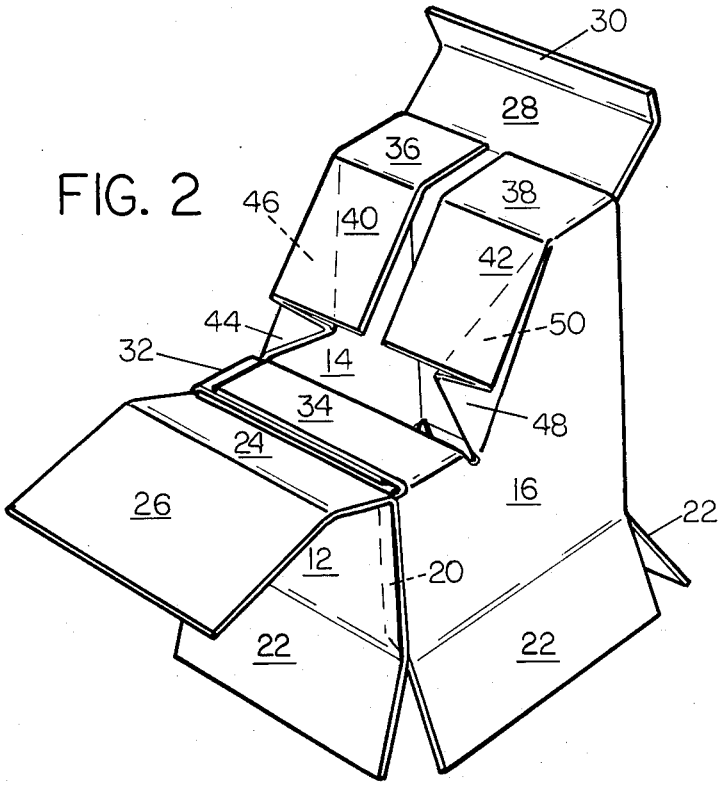
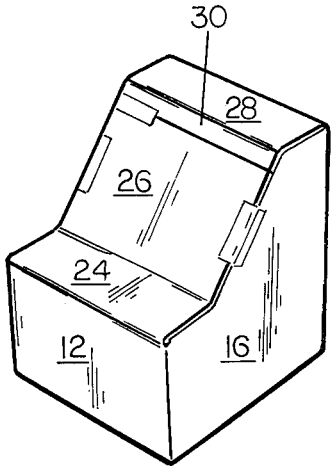
FIG. 3
FIG. 5
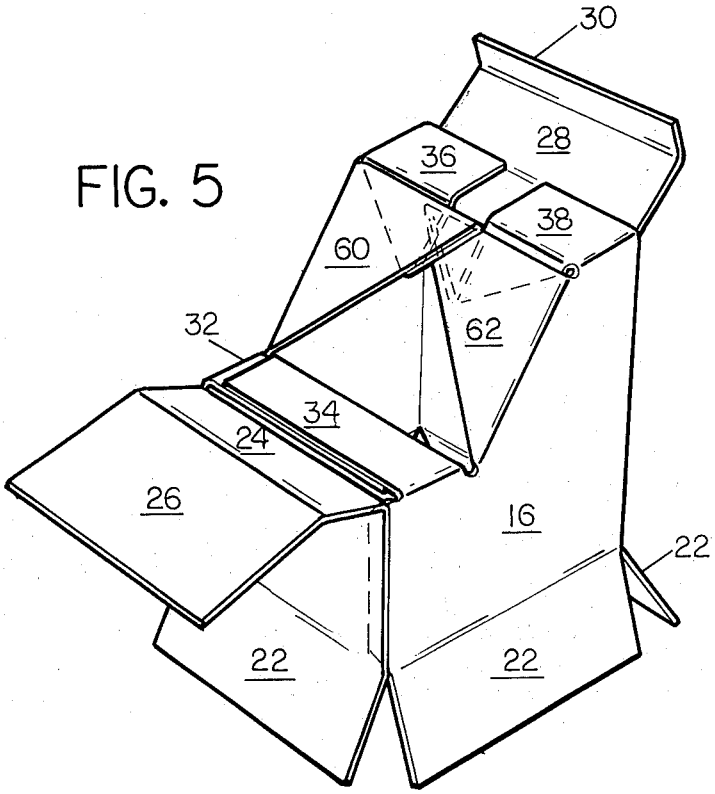

REINFORCED FORM-FITTING SHIPPING CONTAINER

BACKGROUND OF THE INVENTION

This invention relates to shipping containers formed from a blank of paperboard, preferably corrugated paperboard, and more specifically, to form-fitting containers used for shipping and storing upholstered furniture such as upholstered chairs.

A variety of shipping containers for furniture, including upholstered furniture such as chairs, is shown in the prior art. Typical examples are found in the U.S. Pat. Nos. to Nickerson 1,686,834, Rous 2,313,362, Bishop 2,346,003, Gibbons 2,675,955, and Cavin 2,832,525. While of the form-fitting type, the arrangements shown therein have serious disadvantages insofar as they are constructed from two or more separate blank components. For this reason, a considerable amount of labor, besides auxiliary equipment, is required for assembly. Furthermore, a large number of staples is needed for joining the various components together which may result in injury to the upholstery and to unskilled personnel during the packaging or unpacking operation. Moreover, as the various container-forming components are frequently of irregular shape, considerable waste of material is experienced in the preparation of the blanks. In addition, since the components are of different sizes and shapes, keeping an inventory is unduly complicated.

Another example of shipping containers in the prior art is U.S. Pat. No. 3,978,982 to Richard K. Duncan. While the container of the Duncan patent is formed from a one-piece blank, it does not provide multiple layers of reinforcement behind the upper front wall.

SUMMARY OF THE INVENTION

It is, therefore, an object of the invention to provide a one-piece, form-fitting shipping container which overcomes the disadvantages associated with the previously described prior art shipping containers for furniture and the like.

This invention provides a reinforced, form-fitting shipping container formed from a single blank of generally rectangular outline and particularly suited for the shipping and storing of upholstered furniture. As used for upholstered chairs of the type having a relatively low seat and a backrest, the container comprises an intermediate horizontal wall overlying a front portion of the chair, a horizontal top wall extending over the top of the backrest, and an inclined upper front wall extending between the intermediate horizontal wall and top wall. The container is reinforced at areas of increased stress by integral reinforcing elements providing a multi-ply construction of the inclined upper front wall and preferably also of the intermediate horizontal wall and top wall. In the preferred embodiments, the inclined upper front wall is reinforced and stabilized by overlapping scored portions formed thereunder and extending from a pair of sidewalls.

Other objects, features, and advantages of this invention will become obvious to one skilled in the art to which it pertains upon reference to following detailed description and the drawings illustrating preferred embodiments of the invention.

IN THE DRAWINGS

FIG. 2 is a perspective view of a partially assembled container formed from the blank of FIG. 1.

FIG. 3 is a perspective view showing the completed and closed container.

FIG. 5 is a perspective view of a partially assembled container formed from the blank of FIG. 4.

DETAILED DESCRIPTION OF THE PREFERRED EMBODIMENTS OF THE INVENTION

Figure 1:
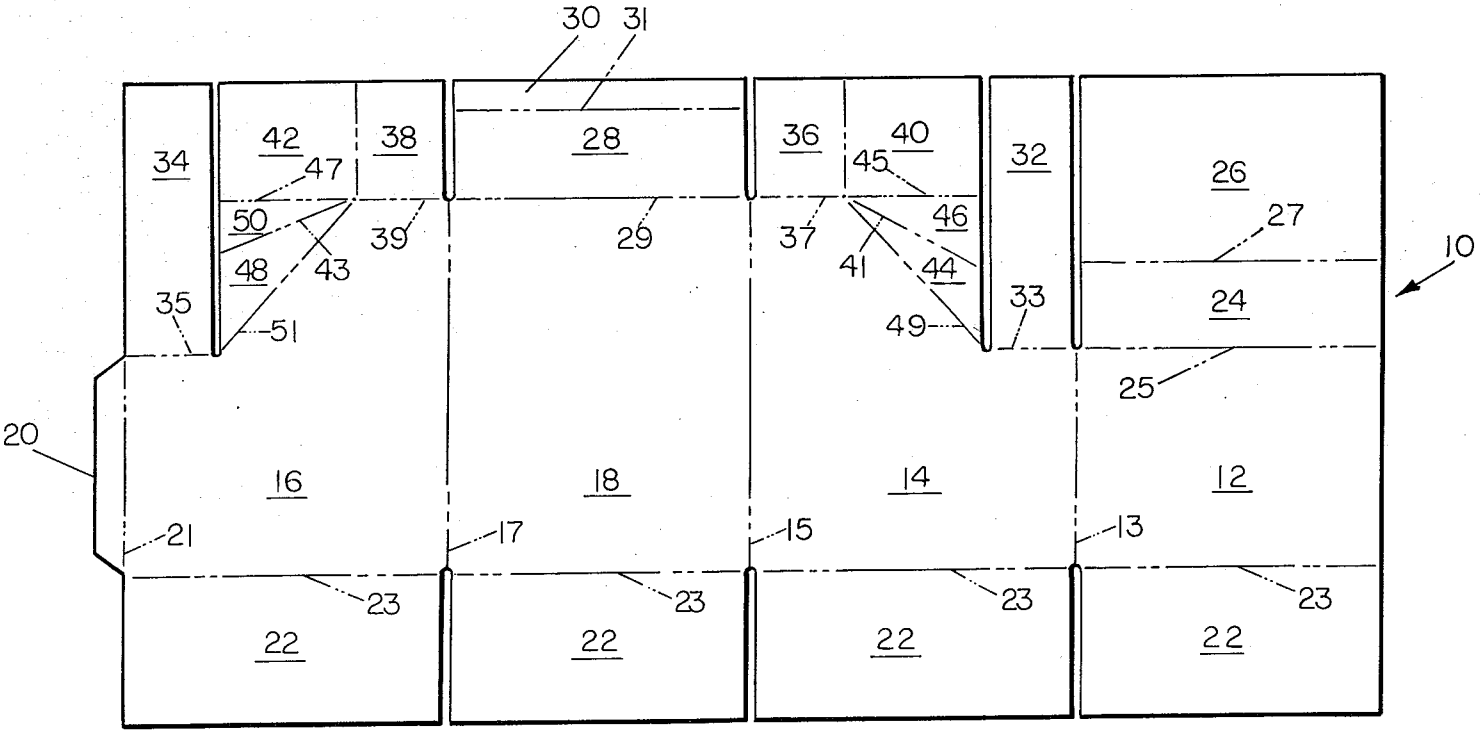
FIG. 1 is a plan view of a blank from which one embodiment of the container of this invention is formed.

In the drawings, a blank of corrugated paperboard material, which is adapted to be folded into the reinforced form-fitting shipping container of this invention, is indicated generally by the numeral 10. The blank 10 includes four adjacent wall panels, which are identified as front wall panel 12, side wall panels 14 and 16, and rear wall panel 18. The wall panels 12, 14, 16, and 18 are foldably connected to each other along score lines 13, 15, and 17 and may be folded into a perpendicular, rectangular configuration. Side wall 16 may be joined with the front wall panel 12 by means of a manufacturer's joint flap 20 which is hingedly connected to the free end of side wall 16 by means of a score line 21. Each of the wall panels 12, 14, 16, and 18 has a bottom closing flap 22 hingedly attached to its lower edge by means of a suitable score line 23. The bottom closing flaps 22 are thereby adapted to be folded into overlapping and interlocking relationship to form a bottom for the container of this invention. An intermediate horizontal wall panel 24 is hingedly connected to the upper edge of front wall panel 12 by means of a score line 25. An inclined upper front wall 26 is similarly foldably attached to the upper edge of intermediate horizontal wall panel 24 along a score line 27.

A relatively narrow top wall panel 28 is foldably attached to the upper edge of the rear wall panel 18 along a score line 29. A front flap 30 is similarly attached to the upper free edge of top wall panel 28 by means of a score line 31, and, as will be understood in connection with FIG. 2, is adapted to be folded into overlapping or abutting relationship with the inclined upper front wall 26. Side walls 14 and 16 each have a first reinforcing flap 32 and 34, attached thereto along score lines 33 and 35, respectively, which are adapted to be folded into overlapping relationship with each other so as to be positioned under the intermediate horizontal wall panel 24, which is attached to the front wall panel 12. Each of the side wall panels 14 and 16 also include a second reinforcing flap 36 and 38, which are hingedly attached to the upper edges of the side walls along score lines 37 and 39, respectively. A pair of stabilizing flaps 40 and 42 are hingedly attached to the reinforcing flaps 36 and 38, respectively. The remaining portions of side walls 14 and 16 are each formed into a pair of triangular-shaped reinforcing panels 44 and 46, and 48 and 50, respectively, which are connected to each other along fold or score lines 41 and 43. The reinforcing panels 46 and 50 are connected to the stabilizing flaps 40 and 42, respectively, along fold or score lines 45 and 47. The reinforcing panels 44 and 48 are connected to the main portion of side walls 14 and 16 along diagonal score lines 49 and 51.

It will be noted that lower horizontal score lines 33 and 35, associated with first reinforcing flaps 32 and 34, are aligned with fold line 25 which defines the forward edge of intermediate horizontal wall 24 in the assembled container. Likewise, upper horizontal score lines 37 and 39, associated with second reinforcing flaps 36 and 38, are aligned with fold line 29, the latter forming the upper edge of rear wall 18 when the container is completed. As previously indicated, these reinforcing flaps have substantially the same width as the respective associated walls; accordingly, the length of the horizontal score lines 33 and 35, identified by the letter *w*, is substantially the same as dimension *x*, designating the distance between fold lines 25 and 27, whereas dimension *y*, defining the length of upper horizontal score lines 37 and 39, corresponds to the distance *z* between fold lines 29 and 31. Furthermore, in the preferred embodiment shown, dimensions *x* and *z* are substantially the same with the result that intermediate horizontal wall 24 and top wall 28 have substantially the same size. This feature will aid in facilitating stabilized resting of the containers during shipping.

As can be seen in FIG. 2, the blank 10 may be folded to a rectangular configuration wherein the four wall panels 12, 14, 16, and 18 are positioned perpendicular to each other, and the manufacturer's joint flap 20 is placed into overlapping engagement with the front wall 12. The bottom closing flaps 22 may then be folded into overlapping relationship to close the bottom of the container. The first reinforcing flaps 32 and 34 may then be folded so that they are perpendicular to the respective side wall panels, 14 and 16, to which they are attached. The second reinforcing flaps 36 and 38 may then be folded so that they are perpendicular to their respective side wall panels 14 and 16. Simultaneously, the stabilizing flaps 40 and 42 are folded downwardly from the reinforcing flaps 36 and 38 to an angle approximating that of the diagonal score lines 49 and 51 which connect reinforcing panels 44 and 48 to the side wall panels 14 and 16. Simultaneously with the folding of stabilizing flaps 40 and 42, reinforcing panels 44 and 46, and 48 and 50 are folded into overlapping relationship beneath (or on top of) the stabilizing flaps 40 and 42. Thus, it can be seen in FIG. 2 that the critical areas overlying the upholstered area of a chair to be positioned within the container of this invention are provided with multiple layers of corrugated paperboard to provide maximum reinforcement and protection for this area of the chair.

To close the container, the intermediate horizontal wall panel 24 is folded so as to be perpendicular to the front wall panel 12 into overlying contact with overlapping first reinforcing flaps 32 and 34. The upper front wall panel 26 is then folded to an appropriate angle relative to the intermediate horizontal wall panel 24 to contact and overlie the stabilizing flaps 40 and 42. As can be seen in FIG. 3, the top wall panel 28 may then be folded to a position perpendicular to the rear wall 18 so as to overlie and contact the second reinforcing flaps 36 and 38 and the front flap 30 is folded into abutting or overlying relationship with respect to the upper front wall panel 26. The front closing flap 30 may then be attached to the upper front wall 26 by means of staples or tape. Similarly, tape may be utilized to overlie the seam formed between the upper front wall panel 26 and the adjacent side wall panels 14 and 16. It should be noted that stitching may be utilized in lieu of taping or stapling.

Thus, a unique reinforced shipping container has been formed from a single blank of corrugated paperboard and is particularly suited for shipping and storing upholstered furniture. This shipping container provides reinforced multiple-layer portions which overlie the front and top portions of the upholstered chair when it is positioned within the shipping container. These reinforced front and top portions are important in protecting the upholstered chair against damage during shipping and storage. They also are important for maintaining the structural stability of the container when such containers are stacked upon one another during shipping and storage.

Figure 4:
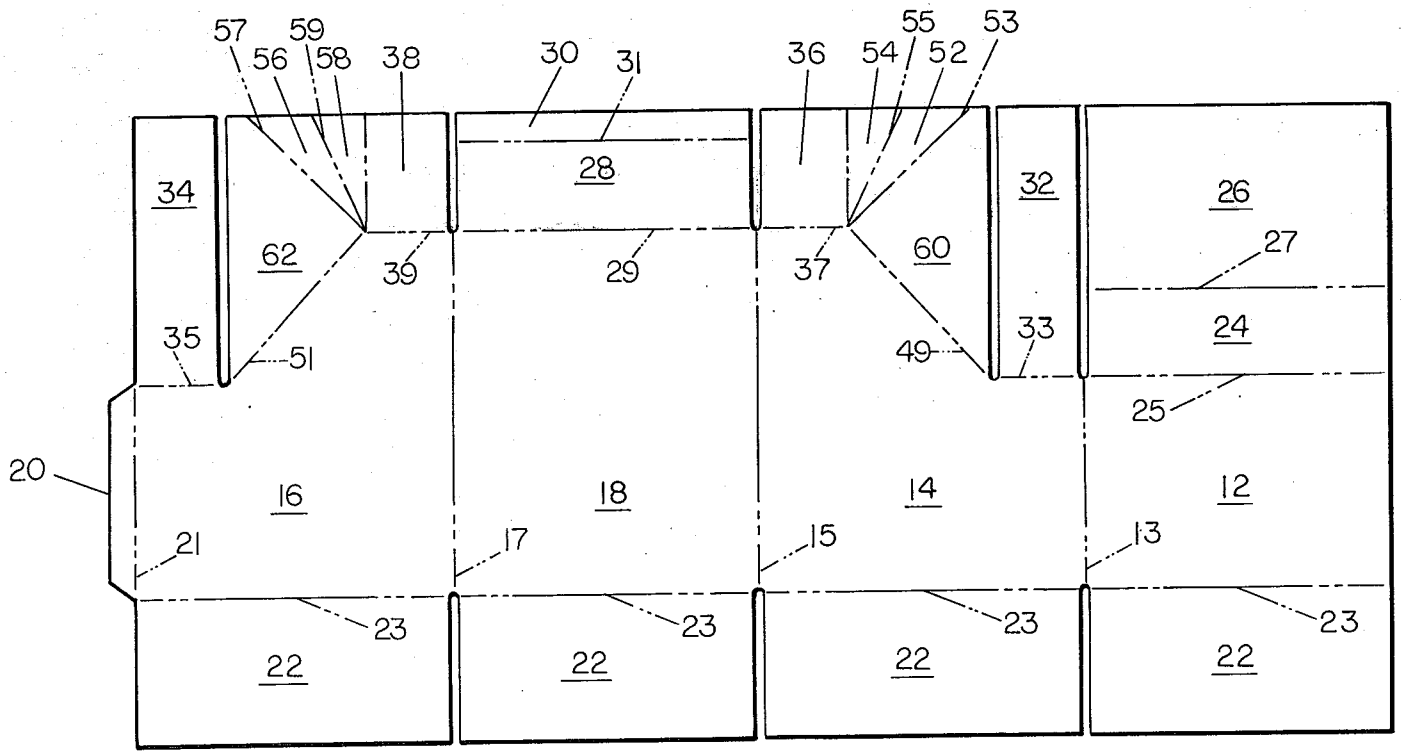
FIG. 4 is a plan view of a blank from which an alternate embodiment of the container of this invention is formed.

FIGS. 4 and 5 depict an alternative embodiment to that shown in FIGS. 1 and 2, in that the stabilizing flaps 40 and 42 of the FIGS. 1 and 2 embodiment have been bisected by fold or score lines 53 and 55, and 57 and 59, respectively, to form two pairs of stabilizing flaps 52 and 54, and 56 and 58. Score lines 53 and 57 are formed approximately perpendicular to the diagonal score lines 49 and 51 to thereby form a pair of large triangular reinforcing panels 60 and 62. In the embodiment of FIGS. 4 and 5, the pair of reinforcing panels 60 and 62 are considerably larger than the corresponding reinforcing panels 44 and 46, and 48 and 50 in the FIGS. 1 and 2 embodiment. As can be seen in FIG. 5, when the enlarged triangular reinforcing panels 60 and 62 are folded into a position perpendicular to the corresponding side wall panels 14 and 16, they overlap and contact each other at their upper corner portions. The triangular-shaped stabilizing flaps 52, 54, 56, and 58 are folded downwardly beneath the reinforcing front panels 60 and 62, to provide additional reinforcing and stabilizing support for the upper front wall panel 26. It should be noted that the embodiment of FIGS. 4 and 5 provides additional reinforcing action adjacent the upper edge of the upper front wall panel 26, which may be important when the container is used for a particular type of upholstered chair. Similarly, the embodiment of FIGS. 1 and 2 provides greater reinforcement of the middle and lower portions of the upper front wall panel 26, which, likewise, may be important for protecting a different type of upholstered chair.

Therefore, the shipping containers as provided by this invention may be formed from a single blank of corrugated paperboard having a generally rectangular outline and are well-suited for shipping and storing upholstered furniture. The shipping containers provided by this invention provide unique reinforcing and stabilizing structural details which have been absent from the prior art to date.

What I claim is:

1. A blank of substantially rectangular outline defined by spaced upper and lower longitudinal edges and spaced transverse side edges, adapted to be formed into a stepped container having a reinforced inclined upper front wall, comprising a series of rectangular blank sections including a front wall section, two side wall sections, and a rear wall section, arranged in side-by-side relation;

said front wall section comprising, in the order named, a lower front wall panel extending upwardly from said lower edge of said blank, an intermediate horizontal wall panel and an upper front wall panel, foldably joined to each other along spaced first and second longitudinal fold lines, respectively;

said rear wall section comprising a rear wall panel extending upwardly from said lower edge of said blank and having a transverse dimension substantially greater than that of said lower front wall panel, and a top wall panel joined to said rear wall panel along an upper longitudinal fold line;

each of said side wall sections comprising a side wall panel having a stepped upper edge defined by a short lower score line aligned with said upper fold line and having a length corresponding to the spacing of said first and second fold lines;

a short upper score line aligned with said upper fold line and having a length corresponding to the transverse dimension of said top wall panel;

a diagonal score line interconnecting said lower and upper score lines;

said side wall sections each including:

a first reinforcing flap foldably joined to said lower score line and defined by slots extending from the ends of said lower score line to the upper edge of said blank, a second reinforcing flap foldably joined to said upper score line and defined by a slot extending from one end of said upper score line to the upper edge of the blank and by a perpendicular score line extending from the other end of the upper score line to the free edge of the blank, at least one stabilizing flap hingedly attached to said second reinforcing flap, and at least one reinforcing panel foldably joined to said side wall panels along said diagonal score line and being foldably attached to said stabilizing flap along a fold line extending from said perpendicular score line to a free edge of said stabilizing flap.

2. The blank of claim 1 wherein said fold line is generally parallel to said upper and lower score lines and aligned with said upper score line so that said stabilizing flaps are generally rectangular in shape and each of said side wall sections include a pair of reinforcing panels foldably connected along a bisecting score line which extends from said perpendicular score line to one of said slots defining said first reinforcing flap.

3. The blank of claim 1 wherein said fold line is generally perpendicular to said diagonal score line and said stabilizing flaps each including a pair of foldably connected sections connected along a bisecting score line which extends from said perpendicular score line to the outer edge of the blank.

4. The blank of claim 1 wherein said rear wall section includes a front flap foldably joined to said top wall panel along a fold line spaced upwardly from said upper fold line.

5. The blank of claim 1, further comprising bottom closure flaps foldably joined to said blank sections along said lower edge of said blank.

* * * * *